United States Patent [19]

Shibuya

[11] Patent Number: 4,468,180

[45] Date of Patent: Aug. 28, 1984

[54] VANE COMPRESSOR HAVING INTERMITTENT OIL PRESSURE TO THE VANE BACK PRESSURE CHAMBER

[75] Inventor: Tsunenori Shibuya, Konan, Japan

[73] Assignee: Diesel Kiki Co., Ltd., Saitama, Japan

[21] Appl. No.: 495,499

[22] Filed: May 17, 1983

[30] Foreign Application Priority Data

May 21, 1982 [JP] Japan ..... 57-85798

[51] Int. Cl.[3] ..... F04C 18/00; F04C 29/02

[52] U.S. Cl. ..... 418/15; 418/93; 418/94; 418/98

[58] Field of Search ..... 418/15, 93, 94, 98, 418/268

[56] References Cited

U.S. PATENT DOCUMENTS

| | | | |
|---|---|---|---|
| 2,027,594 | 1/1936 | Huff | 418/94 |
| 2,050,533 | 8/1936 | Huff | 418/93 |
| 2,522,824 | 9/1950 | Hicks | 418/93 |
| 3,744,942 | 7/1973 | Mount | 418/94 |
| 4,071,306 | 1/1978 | Calabretta | 418/93 |

FOREIGN PATENT DOCUMENTS

| | | | |
|---|---|---|---|
| 2026612 | 2/1980 | United Kingdom | 418/94 |

*Primary Examiner*—John J. Vrablik

*Attorney, Agent, or Firm*—Frishauf, Holtz, Goodman & Woodward

[57] ABSTRACT

The front and rear side blocks are each formed therein with a first lubricating oil passage which supplies high pressure lubricating oil, and at least one of the side blocks is formed therein with a second lubricating oil passage communicating with the back pressure chamber formed within the rotor. The first and second lubricating oil passages each open at one end in the sliding peripheral surface of a plane bearing formed with the corresponding side block. The drive shaft has its interior formed with a lubricating oil chamber and its peripheral wall formed with at least one lubricating oil feeding hole communicating with the lubricating oil chamber. As the drive shaft rotates, the lubricating oil feeding hole intermittently registers with the first lubricating oil passage and the second lubricating oil passage alternately, so that high pressure lubricating oil is intermittently supplied into the back pressure chamber, whereby the pressure of the same lubricating oil is added to the pressure of lubricating oil supplied there through the clearance between the plane bearing and the drive shaft, so as to keep the internal pressure in the back pressure chamber at a proper value.

10 Claims, 5 Drawing Figures

VANE COMPRESSOR HAVING INTERMITTENT OIL PRESSURE TO THE VANE BACK PRESSURE CHAMBER

BACKGROUND OF THE INVENTION

This invention relates to a refrigerant compressor adapted primarily for use in air conditioning systems, and more particularly to a vane compressor having an improved device for applying back pressure to the vanes.

Vane compressors are widely employed as refrigerant compressors in air conditioning systems for automotive vehicles, in general, by virtue of their simple construction and adaptability to operation at high rotational speeds.

As one of vane compressors of this kind, there has conventionally been used a type which includes a pump housing formed by a cam ring and front and rear side blocks secured to opposite ends of the cam ring and accommodating a rotor and vanes, a casing accommodating the pump housing and defining a discharge pressure chamber in cooperation therewith, and a drive shaft extending through the front and rear side blocks and the casing and carrying the rotor secured thereon, and a pair of radial plane bearings formed integrally with the front and side blocks and supporting the drive shaft.

In this type conventional vane compressor, the front and side blocks are each formed therein with a radially extending lubricating oil passage which opens at one end in the discharge pressure chamber and at the other end in the sliding peripheral surface of the corresponding radial plane bearing.

During operation, lubricating oil stored on the bottom of the discharge pressure chamber is forcedly guided through the lubricating oil passages and then through fine clearances between the drive shaft and the radial plane bearings, into a drive shaft-sealing chamber and an oil chamber formed at opposite sides of the radial plane bearings remote from the rotor, and thereafter it is supplied into a back pressure chamber formed within the rotor to apply its own pressure to the vanes as back pressure, while lubricating various sliding portions along its route.

In order to apply a predetermined proper back pressure to the vanes, the clearances between the radial plane bearings and the drive shaft are set at such a value as to produce a value of flow resistance acting upon the lubricating oil passing therein such that the lubricating oil has its pressure reduced from an original high discharge pressure level (e.g. about 15 kg/cm$^2$) to a back pressure level (e.g. about 8.5 kg/cm$^2$) which is intermediate between the discharge pressure level and a suction pressure level (e.g. about 2 kg/cm$^2$). On the other hand, it is a requisite that this clearance value should not be too large enough to spoil the proper bearing function of the radial plane bearings, that is, the function of supporting the drive shaft while allowing free and smooth rotation of same. Therefore, in the above conventional vane compressors, the above clearance value is set at approximately 0.005 mm, for instance, so as to satisfy both the pressure reducing function of the bearings and the bearing function of same.

However, when the compressor is starting, or when thermal load on the air conditioning system is small even during normal steady operation of the compressor, for instance, in a season such as spring and fall, the discharge pressure of the compressor is so small that the difference between the discharge pressure and the suction pressure is not so large as to apply sufficient back pressure to the vanes, because the pressure of lubricating oil supplied to the back pressure chamber through the aforementioned clearances is too small. As a consequence, the vanes cannot maintain its close contact with the camming inner peripheral surface of the cam ring while it is sliding thereon, causing chattering, which results in a reduction in the compression efficiency as well as damage to the compressor parts. To avoid such disadvantage, one would hit upon an idea of providing oil passages for directly guiding lubricating oil from the lubricating oil passages to the back pressure chamber while bypassing the aforementioned clearances. However, to produce required large flow resistance in such oil passages, the diameter of them has to be set at a very small value such that boring of them is practically impossible, whereas if the diameter is set at a larger value so as to enable boring, the resultant flow resistance is too small such that high pressure nearly equal to the discharge pressure prevails in the back pressure chamber, which causes wear of the vanes as well as energy loss.

OBJECTS AND SUMMARY OF THE INVENTION

It is an object of the invention to provide a vane compressor in which the back pressure applying device is adapted to impart a required back pressure to the vanes even when the discharge pressure is low, thereby preventing a reduction in the compression efficiency derived from chattering of the vanes, as well as damage to the compressor parts.

It is a further object of the invention to provide a vane compressor in which the back pressure applying device is easy to machine and therefore has high productivity.

According to the invention, a pair of first lubricating oil passages are formed in the front and side blocks, each of which has one end communicating with a zone under discharge pressure of the compressor and the other end opening in the sliding peripheral surface of a corresponding one of a pair of radial plane bearings formed with the side blocks. A drive shaft, which is radially supported by the above radial plane bearings and carries a rotor secured thereon, has its interior formed with a lubricating oil chamber formed therein and its peripheral wall formed with at least one lubricating oil feeding hole having one end opening in the lubricating oil chamber and the other end terminating in the outer peripheral surface of the drive shaft. The above other end of the lubricating oil feeding hole terminating in the outer peripheral surface of the drive shaft is located at such a predetermined axial location that as the drive shaft rotates, the same end of the lubricating oil feeding hole intermittently registers with the above other end of a corresponding one of the first lubricating oil passages. The rotor has its interior formed with a back pressure chamber which opens in at least one of the opposite end faces of the rotor. At least one second lubricating oil passage is formed in at least one of the front and rear side blocks, one end of which opens in the sliding peripheral surface of a corresponding one of the radial plane bearings, at such a predetermined axial location that as the drive shaft rotates, the same one end of the second lubricating oil passage intermittently registers with the above other end of a corresponding one of the lubricating oil feeding hole. The other end of the second lubricating oil passage opens in an end face of a corresponding one of the front and rear side blocks facing the back pressure chamber.

The above and other objects, features and advantages of the invention will be more apparent from the ensuing detailed description take in connection with the accompanying drawings.

DETAILED DESCRIPTION

The invention will now be described in detail with reference to the drawings.

Figure 1:
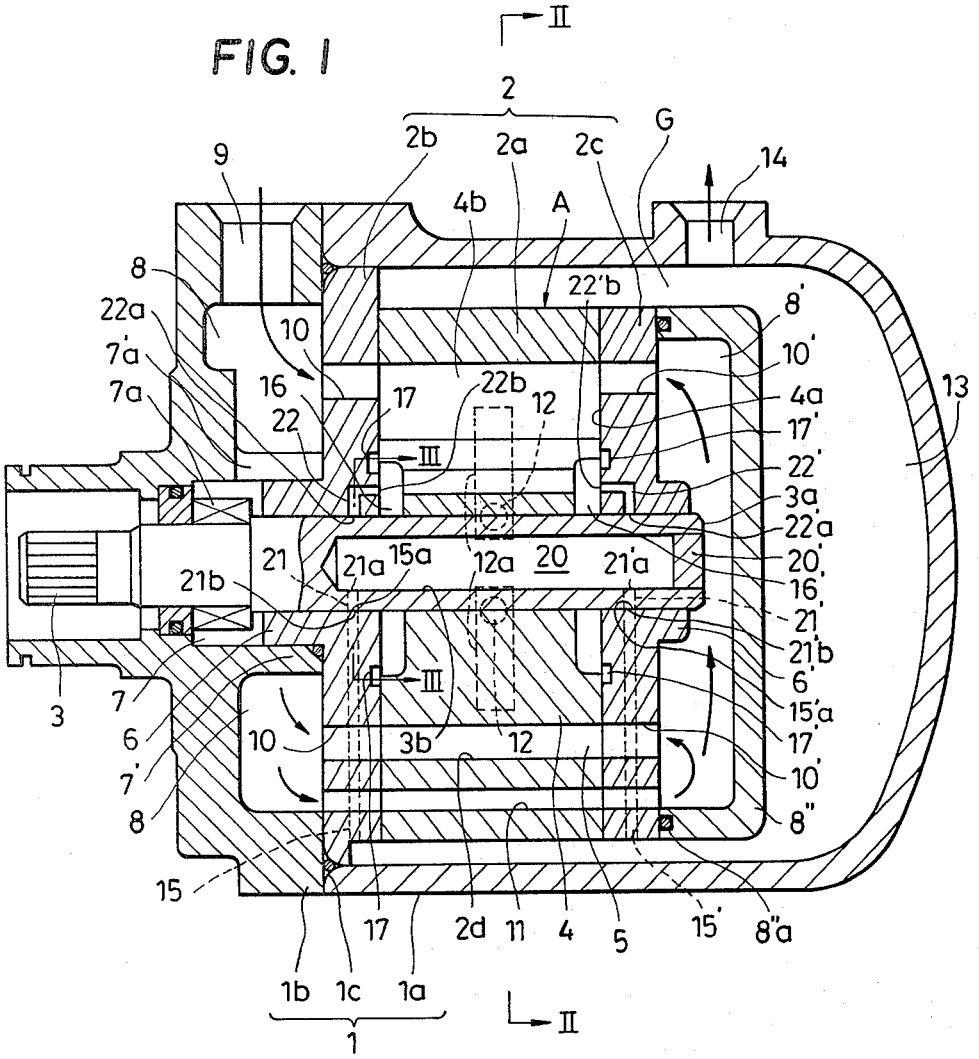
FIG. 1 is a longitudinal vertical sectional view of a vane compressor of the diametrically symmetrical double chamber type, according to a first embodiment of the invention.
Figure 3:
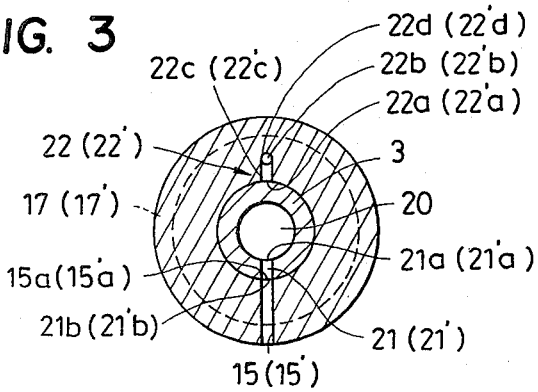
FIG. 3 is a fragmentary sectional view taken along line III—III in FIG. 1.
Figure 2:
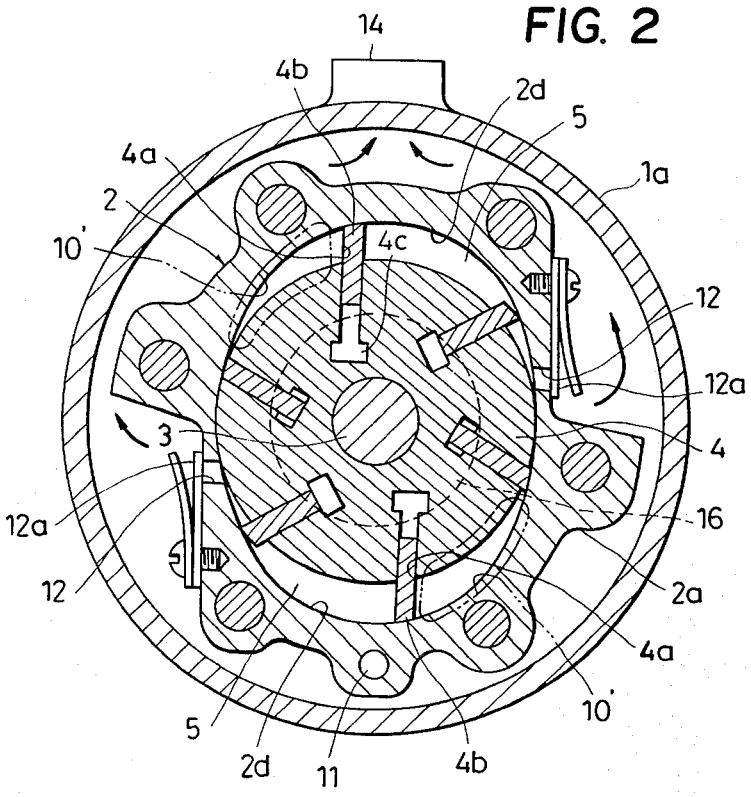
FIG. 2 is a sectional view taken along line II—II in FIG. 1.

Referring first to FIGS. 1 through 3, there is illustrated a vane compressor of the diametrically symmetrical double chamber type, according to a first embodiment of the invention. A compressor casing 1 is formed by a generally cylindrical covering 1*a* and a front head 1*b*, within which is accommodated a pump housing 2 which is formed by an ellipsoidal cam ring 2*a*, and front and rear side blocks 2*b* and 2*c* secured to the opposite ends of the cam ring 2*a*. The front side block 2*b* is fixed to the front head 1*b* in a manner that the pump housing 2 is supported by the front head 1*b*. The covering 1*a* is joined to the front head 1*b* by means of bolts, not shown, with its open end abutting against the front head 1*b* in a gastight manner with an annular sealing member 1*c* interposed therebetween. A drive shaft 3 has its rear end portion inserted into the pump housing 2, on which is rigidly secured a cylindrical rotor 4 which cooperates with the pump housing 2 to form a pump assembly A and which has a plurality of axial slits 4*a* formed in its outer peripheral surface and carries as many plate-like vanes 4*b* fitted in the slits 4*a* for radial movement. Pump working chambers 5 are defined between the rotor 4, adjacent vanes 4*b*, the endless camming inner peripheral surface of the cam ring 2*a*, and the inner end faces of the opposite front and rear side blocks 2*b*, 2*c*. The drive shaft 3 is journalled by front and rear radial plane bearings 6 and 6' formed integrally with the front side block 2*b* and the rear side block 2*c*, respectively, and axially extends in a gastight manner through a shaft-seal means 7*a* mounted in a sealing chamber 7 formed within the front head 1*b*.

Defined between the front head 1*b* and the front side block 2*b* is a front suction chamber 8 which is annular in shape and disposed around the sealing chamber 7. The front suction chamber 8 communicates with the sealing chamber 7 through a communicating passage 7'*a* formed by cutting out part of a cylindrical partition wall 7' formed in the front head 1*b* in a manner separating the two chambers 7, 8 from each other, and at the same time, the front suction chamber 8 communicates with a suction port 9 formed in the front head 1*b* as well as with the interior of pump working chambers 5 on the suction stroke, through front pump inlets 10 formed through the front side block 2*b*. On the other hand, a dished partition member 8'' is secured to a rear end face of the rear side block 2*c*, which cooperates with the rear side block 2*c* to define therebetween a rear suction chamber 8' which communicates with the front suction chamber 8 by way of a suction passageway 11 axially extending through the front side block 2*b*, the cam ring 2*a*, and the rear side block 2*c* at a location corresponding to a lower peripheral wall portion of the pump housing 2, as well as with the pump working chambers 5 on the suction stroke through rear pump inlets 10' formed through the rear side block 2*c*. Pump working chambers 5 on the discharge stroke are disposed for communication with a discharge pressure chamber 13 defined within the covering 1*a* at a rear side of the pump housing 2, by way of pump outlets 12 formed through the peripheral wall of the cam ring 2*a*, discharge valves 12*a*, and gaps between the outer peripheral surface of the pump housing 2 and the inner surfaces of the covering 1*a*. A discharge port 14 is formed through the ceiling wall of the covering 1*a* and opens in the discharge pressure chamber 13.

Front and rear lubricating oil passages 15 and 15' are formed, respectively, in the front side block 2*b* and the rear side block 2*c*, which extend from lower peripheral surfaces of the respective side blocks and terminate in the sliding inner peripheral surfaces of the associated plane bearings 6, 6'. On the other hand, the rotor 4 has its front and rear end faces, respectively, formed with front and rear annular back pressure chambers 16 and 16' disposed adjacent and around the drive shaft 3, both of which communicate with a central back pressure chamber 4*c* formed within the rotor 4 and communicating with the bottoms of the axial slits 4*a*, as shown in FIG. 2. Annular grooves 17 and 17' are formed in inner end faces of the front and rear side blocks 2*b*, 2*c*, which have their radially inner halves opening in the associated annular back pressure chambers 16, 16'.

The drive shaft 3 has its interior formed with a blind hole 3*b* axially extending from an end face 3*a* of the drive shaft 3 on the side of the rear side block 3*a* and terminating at an axially intermediate portion of same. The blind hole 3*b* has its open rear end obtruded by a plug 20' fitted therein so that its interior defines a lubricating oil chamber 20 in cooperation with an inner end face of the plug 20'. Front and rear lubricating feeding holes 21 and 21' are radially formed through a peripheral wall portion of the drive shaft 3, which have their inner ends 21*a* and 21'*a* opening in the lubricating oil chamber 20 and the other or outer ends 21*b* and 21'*b* terminating in portions of the outer peripheral surface of the drive shaft 3 which are disposed in sliding contact with the sliding inner peripheral surfaces of the front and rear plane bearings 6, 6', at such axial locations that the other ends 21*b*, 21'*b* can register with the upper open ends 15*a*, 15'*a* of the respective lubricating oil passages 15, 15'. More specifically, as the drive shaft 3 rotates, the lubricating oil feeding holes 21, 21' correspondingly revolve so that their outer ends 21*b*, 21'*b* come across the upper open ends 15*a*, 15'*a* of the respective lubricating oil passages 15, 15' in an intermittent manner so as to intermittently communicate the lubricating oil passages 15, 15' with the lubricating oil chamber 20, that is, one time per rotation of the drive shaft 3 in the illustrated embodiment. Preferably, the diameters of the lubricating oil passages 15, 15' and the lubricating oil feeding bores 21, 21' are set at approximately 1 mm or more.

On the other hand, further lubricating oil passages 22 and 22' are formed in the front and rear side blocks **2*b*, 2*c* at a side diametrically opposite to the first-mentioned lubricating oil passages 15, 15' with respect to the axis of the drive shaft 3. These lubricating oil passages 22, 22' each have a radially extending inner half portion 22*c*, 22'*c* and an axially extending outer half portion 22*d*, 22'd, presenting a generally L-shaped cross section. Each of the lubricating oil passages 22, 22' has a radially inner end 22*a* 22'*a* terminating in the sliding peripheral surface of a corresponding one of the plane bearings 6, 6' at such an axial location that it can intermittently register with the outer end 21*b*, 21'*b* of the associated lubricating oil feeding hole 21, 21' as the drive shaft 3 rotates. In the illustrated embodiment, as clearly shown in FIG. 3, the radially inner end 22*a*, 22'*a* of the lubricating oil passage 22, 22' is located diametrically opposite to the associated upper end 15*a*, 15'*a* of the lubricating oil passage 15, 15' with respect to the axis of the drive shaft 3. On the other hand, the radially outer ends 22*b*, 22'*b* of the lubricating oil passages 22, 22' terminate in the inner end faces of the respective side blocks facing the rotor 4 and open in the respective annular back pressure chambers 16, 16'. Thus, as the drive shaft 3 rotates, the lubricating oil passages 22, 22' and the feeding holes 21, 21' cooperatively establish intermittent communication of the lubricating oil chamber 20 in the drive shaft 3 with the annular back pressure chambers 16, 16', that is, one time per rotation of the drive shaft 3** in the illustrated embodiment.

The vane compressor according to the invention constructed as above operates as follows: As the rotor 4 is rotated with the drive shaft 3 in unison with the engine of an associated automotive vehicle, not shown, or a like prime mover, the vanes **4*b* correspondingly revolve with their tips kept in sliding contact with the camming inner peripheral surface of the cam ring 2*a* due to centrifugal force and the back pressure of lubricating oil acting upon the vanes, and accordingly refrigerant is introduced into the front suction chamber 8 through the suction port 9. The suction refrigerant thus introduced into the front suction chamber 8 and having a relatively low temperature is guided into the sealing chamber 7 through the communication passage 7'*a* to cool the front plane bearing 6 partly disposed in the sealing chamber 7, as well as the shaft-seal means 7*a* and also maintain the internal pressure of the sealing chamber 7 at low pressures (about 2 kg/cm$^2$). The greater part of the suction refrigerant in the front suction chamber 8 is sucked into the pump working chambers 5 through the front pump inlets 10, and the remainder of the suction refrigerant is guided into the rear suction chamber 8' through the suction passageway 11 to keep the pressure at or in the vicinity of a portion of the rear plane bearing 6' remote from the rotor 4 at low pressures (about 2 kg/cm$^2$), and then is sucked into the pump working chambers 5 through the rear pump inlets 10'. The refrigerant sucked into the pump working chambers 5 is compressed during the compression stroke of same and discharged into the discharge pressure chamber 13 through the pump outlets 12 and the discharge valves 12*a* then opened, during the discharge stroke of the pump working chambers 5. These series of strokes are repeatedly carried out, and accordingly the discharged refrigerant is accummulated in the discharge pressure chamber 13 and supplied through the discharge port 14** to the refrigerating cycle, not shown, of the associated air cooling system.

Lubricating oil contained in the refrigerant is separated from the latter in the discharge pressure chamber 13 and stored on the bottom of the covering **1*a*. The lubricating oil is forced by high discharge pressure (about 15 kg/cm$^2$) to travel in the front and rear lubricating oil passages 15, 15' into the fine clearances having a clearance value of about 0.005 mm between the front and rear plane bearings 6, 6' and the drive shaft 3. Each time the outer ends 21*b*, 21'*b* of the revolving lubricating oil feeding holes 21, 21' meet with the upper ends 15*a*, 15'*a* of the lubricating oil passages 15, 15' as the drive shaft 3 rotates, the refrigerant in the clearances is introduced into the lubricating oil chamber 20. Since the lubricating oil passages 15, 15' and the lubricating oil feeding holes 21, 21' having diameters of approximately 1 mm or more as previously noted, lubricating oil, which then has a pressure nearly equal to the discharge pressure, is rapidly introduced into the lubricating oil chamber 20. Further, since the lubricating oil is in a semi-gaseous state with refrigerant (Freon) dissolved therein in large percents and therefore compressible, the internal pressure of the lubricating oil chamber 20 is kept at a high pressure even after the lubricating oil feeding holes 21, 21' are closed by the inner peripheral surfaces of the plane bearings 6, 6'as the drive shaft 3 rotates. In addition, the internal pressure of the lubricating oil chamber 20 is further increased with an increase in the temperature of the drive shaft 3 which is caused by its sliding contact with the bearings 6, 6' as well as by the sliding engagements of the other peripheral parts. As the drive shaft 3 further rotates to have its lubricating oil feeding holes 21, 21' become aligned with the radially inner ends 22*a*, 22'*a* of the lubricating oil passages 22, 22', part of the lubricating oil in the lubricating oil chamber 20 is discharged through the holes 21, 21' into the lubricating oil passages 22, 22' and then into the annular back pressure chambers 16, 16', where the pressure of the lubricating oil is added to the pressure of lubricating oil which, as hereinafter referred to, is supplied into the same chambers 16, 16' through the clearances between the plane bearings 6, 6' and the drive shaft 3, and the lubricating oil thus having a combined or increased pressure flows into the central back pressure chamber 4*c* to apply the combined pressure to the vanes 4*b*** as a proper pressure.

On the other hand, the other part of the lubricating oil in the above clearances than the one introduced into the lubricating oil chamber 20 is divided into two axially opposite flows, one of which flows through the same clearances into the front and rear annular back pressure chambers 16, 16' after having its pressure reduced from the discharge pressure level to a level nearly to the back pressure level (about 8.5 kg/cm$^2$) under flow resistance in the clearances. This lubricating oil is joined in the back pressure chambers 16, 16' with the one introduced therein through the lubricating oil passages 22, 22' and is delivered to the sliding surfaces of the rotor 4 and the front and rear side blocks **2*b*, 2*c* via the annular grooves 17, 17', as well as to the sliding surfaces of the vanes 4*b* and the axial slits 4*a*, to lubricate these sliding surfaces, and sucked into the pump working chambers 5** on the suction stroke, together with refrigerant.

The other part of the lubricating oil in the above clearances flows through the same clearances in directions away from the rotor 4, while lubricating the plane bearings 6, 6', into the sealing chamber 7, on one hand, to lubricate the shaft-seal means *7a*, and then guided into the front suction chamber 8, to be sucked into the pump working chambers 5 through the front pump inlets 10 together with suction refrigerant, and on the other hand, into the rear suction chamber 8' to be sucked into the pump working chambers 5 through the rear pump inlets 10', together with suction refgrigerant. The lubricating oil in the pump working chambers 5 is discharged together with compressed refrigerant into the discharge pressure chamber 13, where it is again separated from the refrigerant. The same cycle repeatedly takes place.

Figure 4:
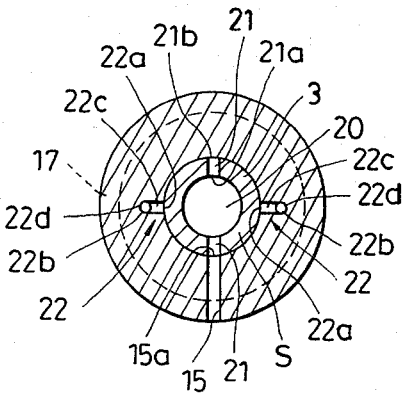
FIG. 4 is a view similar to FIG. 3, illustrating a modification of the lubricating oil feeding hole and the second lubricating oil passage.

FIG. 4 illustrates a modification of the lubricating oil feeding holes 21, 21' and the lubricating oil passages 22, 22'. At the side of the front side block *2b*, two lubricating oil feeding holes 21 and 21 formed in the drive shaft 3 are circumferentially arranged on the same radial plane S at angular intervals of 180 degrees, while two lubricating oil passages 22 and 22 formed in the front side block *2b* have their radially inner half portions *22c* and *22c* are circumferentially arranged on the same radial plane S at angular intervals of 180 degrees and alternately with the feeding holes 21, 21. The same arrangement is applied to the side of the rear side block *2c*, illustration and description of which are therefore omitted.

The arrangement and number of the lubricating oil feeding holes 21, 21' and the lubricating oil passages 22, 22' are not limited to those of the aforegiven embodiment and modification. For instance, the number and diameter of these holes and/or passages as well as the volume of the lubricating oil chamber 20 may be suitably selected so as to obtain a proper back pressure to be applied to the vanes in consideration of the amount and pressure of lubricating oil supplied to the back pressure chambers 16, 16' through the lubricating oil chamber 20 and through the clearances between the drive shaft 3 and the plane bearings 6, 6'.

Figure 5:
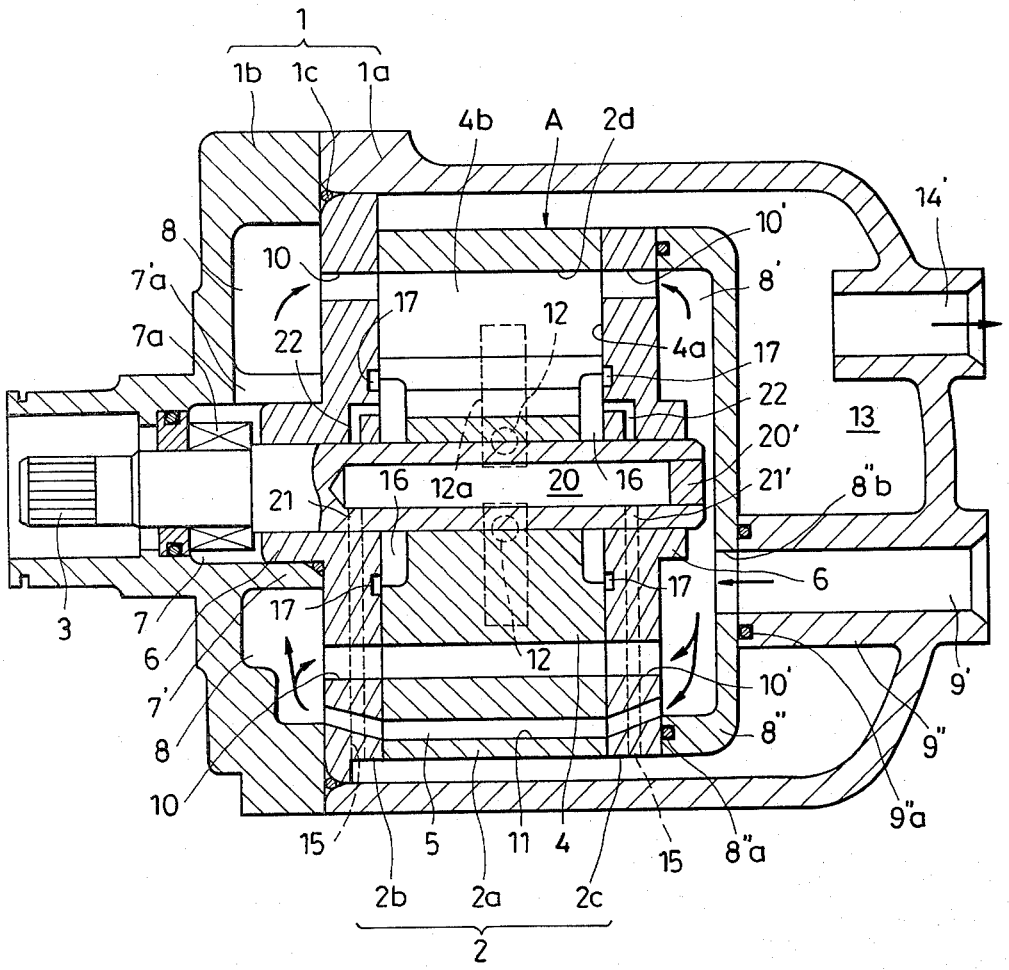
FIG. 5 is a view similar to FIG. 1, illustrating a vane compressor according to a second embodiment of the invention.

FIG. 5 illustrates a second embodiment of the invention in which the back pressure applying device of the invention is applied to a vane compressor which has its suction port 9' and discharge port 14' both formed in the covering 1*a* at a rear end wall of same. In FIG. 5, elements and parts corresponding to those in FIG. 1 are designated by identical reference numerals. According to this embodiment, the suction port 9', which is formed through the rear end wall of the covering 1*a* as noted above, is connected directly with the rear suction chamber 8' by means of a hollow passage defining portion 9'' disposed in the disacharge pressure chamber 13 and axially extending integrally from the rear end wall of the covering 1*a*. The hollow passage defining portion 9'' has one end combined integrally with the rear end wall of the covering 1*a* in alignment with the suction port 9' and the other or inner end aligned with a through hole 8''*b* formed through the partition member 8' and secured thereto via a sealing member 9''*a*. The other elements and parts, not referred to above, are identical in arrangement with those in FIG. 1, and also the operation of the present embodiment is substantially identical with that of FIG. 1, description of which is therefore omitted.

The present invention can provide various excellent results, as below:

(1) By virtue of the arrangement that during rotation of the drive shaft 3, the lubricating oil feeding holes 21, 21' formed in the drive shaft 3 intermittently connected between the first lubricating oil passages 15, 15' in which high pressure lubricating oil prevails and the lubricating oil chamber 20 formed in the drive shaft 3 and also between the lubricating oil chamber 20 and the second lubricating oil passages 22, 22' communicating with the back pressure chambers 16, 16', so as to feed high pressure lubricating oil to the back pressure chamber 4*c*, a proper or sufficient level of back pressure can be applied to the vanes 4*b*, which is the sum of the pressure of lubricating oil supplied into the back pressure chambers 16, 16' through the clearances between the drive shaft 3 and the plane bearings 6, 6' and the pressure of the above lubricating oil supplied there through the above lubricating oil chamber 20, the feeding holes 21, 21' and the second lubricating oil passages 22, 22', even when the discharge pressure is low such as at the start of the compressor and when the thermal load on the compressor is small, for instance, in spring or in fall.

(2) Since the communication between the first lubricating oil passages 15, 15' and the back pressure chamber 4*c* is made in an intermittent manner as the drive shaft 3 rotates, it is not necessary to design the diameters of the first and second lubricating oil passages 15, 15' and 22, 22' and the lubricating oil feeding holes 21, 21' at such very small values that they are practically impossible to bore, to achieve the supply of a proper lubricating oil to the back pressure chambers, thereby facilitating the manufacture of the compressor.

(3) The lubricating oil chamber 20 having a substantial volume, intervening between the first lubricating oil passages 15, 15' and the back pressure chamber 4*c* temporarily stores lubricating oil under high pressure to thereby enable prompt supply of the high pressure lubricating oil to the back pressure chamber 4*c*, except when the lubricating oil feeding holes 21, 21'happen to register with the first or second lubricating oil passages when the compressor is stopped. This is advantageous to a compressor for use in an air conditioning system which is adapted to control the discharge air temperature through repeated on-off actions of the compressor.

What is claimed is:

1. A vane compressor comprising: a cam ring having an endless camming inner peripheral surface and opposite ends; front and rear side blocks secured to said opposite ends of said cam ring and cooperating therewith to form a pump housing; a rotor accommodated within said pump housing and having opposite end faces, said rotor having an outer peripheral surface thereof formed with a plurality of axial slits each having a radially inner end, and an interior thereof formed with a back pressure chamber communicating with said radially inner end of each of said axial slits and terminating in at least one of said opposite end faces of said rotor, said front and rear side blocks each having an end face facing said rotor; a plurality of vanes radially slidably fitted in said axial slits of said rotor for sliding contact with said endless camming inner peripheral surface of said cam ring, wherein adjacent ones of said vanes cooperate with said pump housing and said rotor to define therebetween pump working chambers; a pair of plane bearings provided on said front and rear side blocks and each having a sliding inner peripheral surface; a drive shaft having part thereof disposed within said pump housing and carrying said rotor secured thereon, said drive shaft being radially supported by said plane bearings at said sliding inner peripheral surfaces thereof, said drive shaft having an outer peripheral surface; a pair of first lubricating oil passages formed in said front and rear side blocks, said first lubricating oil passages each having one end communicating with oil in a zone under discharge pressure in the compressor and another end opening in said sliding peripheral surfaces of respective ones of said plane bearings; a lubricating oil chamber defined within said drive shaft; at least one lubricating oil feeding hole formed in said drive shaft, said lubricating oil feeding hole having one end opening in said lubricating oil chamber, said lubricating oil feeding hole having another end terminating in said outer peripheral surface of said drive shaft at a predetermined axial location such that as said drive shaft rotates, said another end of said lubricating oil feeding hole intermittently registers with said another end of a corresponding one of said first lubricating oil passages; at least one second lubricating oil passage formed in at least one of said front and rear side blocks, said second lubricating oil passage having one end opening in said sliding inner peripheral surface of a corresponding one of said plane bearings at a predetermined axial location such that as said drive shaft rotates, said one end of said second lubricating oil passage intermittently registers with said another end of said lubricating oil feeding hole, said second lubricating oil passage having another end terminating in said end face of a corresponding one of said front and rear side blocks at a location positionally corresponding to said back pressure chamber.

2. A vane compressor as claimed in claim 1, wherein said back pressure chamber comprises a first back pressure chamber formed within said rotor and communicating with said radially inner end of each of said axial slits, and a second back pressure chamber having an annular shape and formed in said opposite end faces of said rotor and around said drive shaft, said second back pressure chamber communicating with said first back pressure chamber.

3. A vane compressor as claimed in claim 1, wherein said drive shaft has one end located at said rear side block, and said lubricating oil chamber is defined by a blind hole formed within said drive shaft and axially extending from said one end of said drive shaft, and a plug fitted in said blind hole at said one end of said drive shaft.

4. A vane compressor as claimed in claim 1, wherein said lubricating oil feeding hole comprises a plurality of such holes circumferentially arranged on the same radial plane extending through said drive shaft.

5. A vane compressor as claimed in claim 1, wherein said second lubricating oil passage comprises a plurality of such passages circumferentially arranged on the same radial plane extending through a corresponding one of said front and rear side blocks.

6. A vane compressor as claimed in claim 1, wherein said one end of said second lubricating oil passage is arranged diametrically opposite to said another end of a corresponding one of said first lubricating oil passages with respect to the axis of said drive shaft.

7. A vane compressor as claimed in claim 1, including a front head to which is secured said front side block, a suction port formed in said front head, a suction chamber defined between said front head and said front side block, and at least one pump inlet formed through said front side block, and wherein said suction chamber communicates with said pump working chambers on suction stroke thereof through said pump inlet.

8. A vane compressor as claimed in claim 7, further including a partition member secured to said rear side block at an end face thereof remote from said rotor and defining therebetween a second suction chamber, at least one pump inlet formed through said rear side block, and a passageway axially extending through said pump housing and communicating said first-mentioned suction chamber with said second suction chamber.

9. A vane compressor as claimed in claim 7, including a sealing chamber defined between said front head and said front side block and surrounded by said first-mentioned suction chamber, seal means mounted in said sealing chamber for sealing said drive shaft in a gastight manner, and a partition wall separating said sealing chamber and said suction chamber from each other, said partition wall having an opening formed therethrough and communicating said sealing chamber with said suction chamber.

10. A vane compressor as claimed in claim 1, further including a partition member secured to said rear side block at an end face remote from said rotor and defining therebetween a suction chamber, said partition member having a through hole formed therein, at least one pump inlet formed through said rear side block and communicating said suction chamber with said pump working chambers on suction stroke thereof, and a compressor casing accommodating said pump housing, said compressor casing having a rear end wall formed with a suction port and a hollow passage defining portion, said hollow passage defining portion having one end aligned with said suction port and another end aligned with said through hole formed in said partition member.

* * * * *